United States Patent [19]

Taylor

[11] 4,053,958

[45] Oct. 18, 1977

[54] SURFACE PREPARATION MACHINE

[76] Inventor: Leland Z. Taylor, P.O. Box 756, Wichita, Kans. 67201

[21] Appl. No.: 643,612

[22] Filed: Dec. 22, 1975

[51] Int. Cl.[2] ..... A47L 11/12

[52] U.S. Cl. ..... 15/93 R; 51/170 MT; 173/24; 299/37

[58] Field of Search ..... 15/93 R, 98, 49 RB, 15/50 A; 299/37; 51/170 MT, 170 TL, 175; 173/24

[56] References Cited

U.S. PATENT DOCUMENTS

| | | | |
|---|---|---|---|
| 2,874,946 | 2/1959 | Singleterry et al. | 299/37 |
| 3,074,090 | 1/1963 | Thompson | 15/93 R |
| 3,345,784 | 10/1967 | Stelljes et al. | 51/170 MT |

*Primary Examiner*—Edward L. Roberts
*Attorney, Agent, or Firm*—Edwin H. Crabtree; John H. Widdowson

[57] ABSTRACT

This device consists primarily of a tool (blade, chisel, or sanding attachment) which is attached to a tool holder. The tool holder in turn is attached by a bearing to a shaft which passes thru a flywheel, the shaft is offset from the center of the flywheel thereby causing an eccentric rotation of the tool holder. The flywheel and tool holder "float" as an assembly on rubber couplings and impart to the tool components of these various motions slicing, chopping, scraping, and rubbing.

5 Claims, 3 Drawing Figures

SURFACE PREPARATION MACHINE

This machine is a simple powered means to remove such substances as carpet, tile, roofing, ice, or other substances which have been adhered or otherwise applying to floors, sidewalks, drives, roofs, or other surfaces.

The above mentioned substances have been classically removed with shovels, hoes, forks, or other sharp bladed instruments.

The available machines suffered from these disadvantages.

1. Because the blade was moved by direct means such as a powered crankshaft, action-reaction caused the machines to vibrate violently.

2. To keep the machine from vibrating violently, weight had to be added to increase the machine's inertia making such machines unnecessarily heavy and cumbersome.

Figure 1:
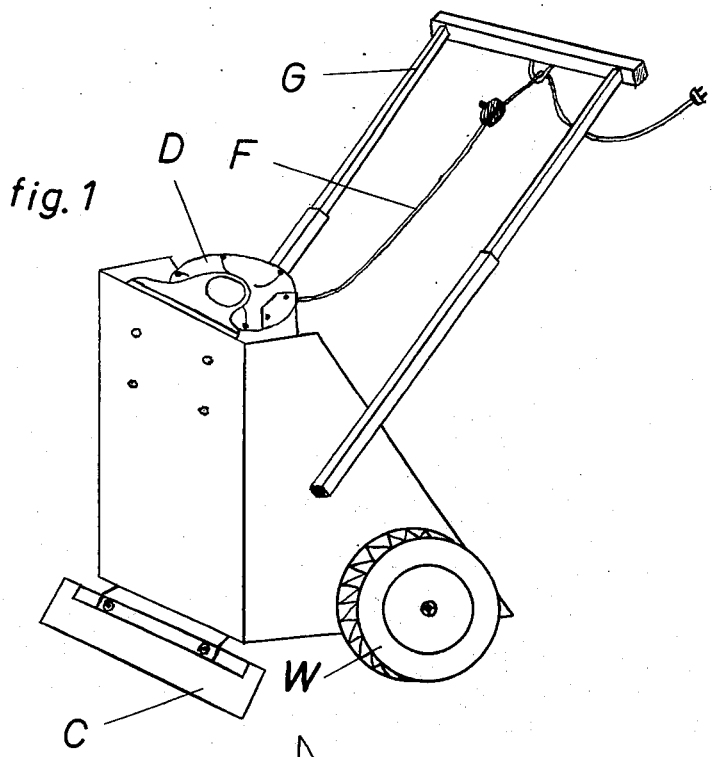

The drawing FIG. 1 shows a complete machine mounted on a wheeled frame set up with blade for removal of soft materials such as carpet or foam padding. Other materials such as tile, ice, linoleum, or vinyl can be removed with a narrower blade, increasing the cutting force. Paint, varnish, or other substances are removed efficiently with a standing attachment placed where the blade normally is.

Figure 2:
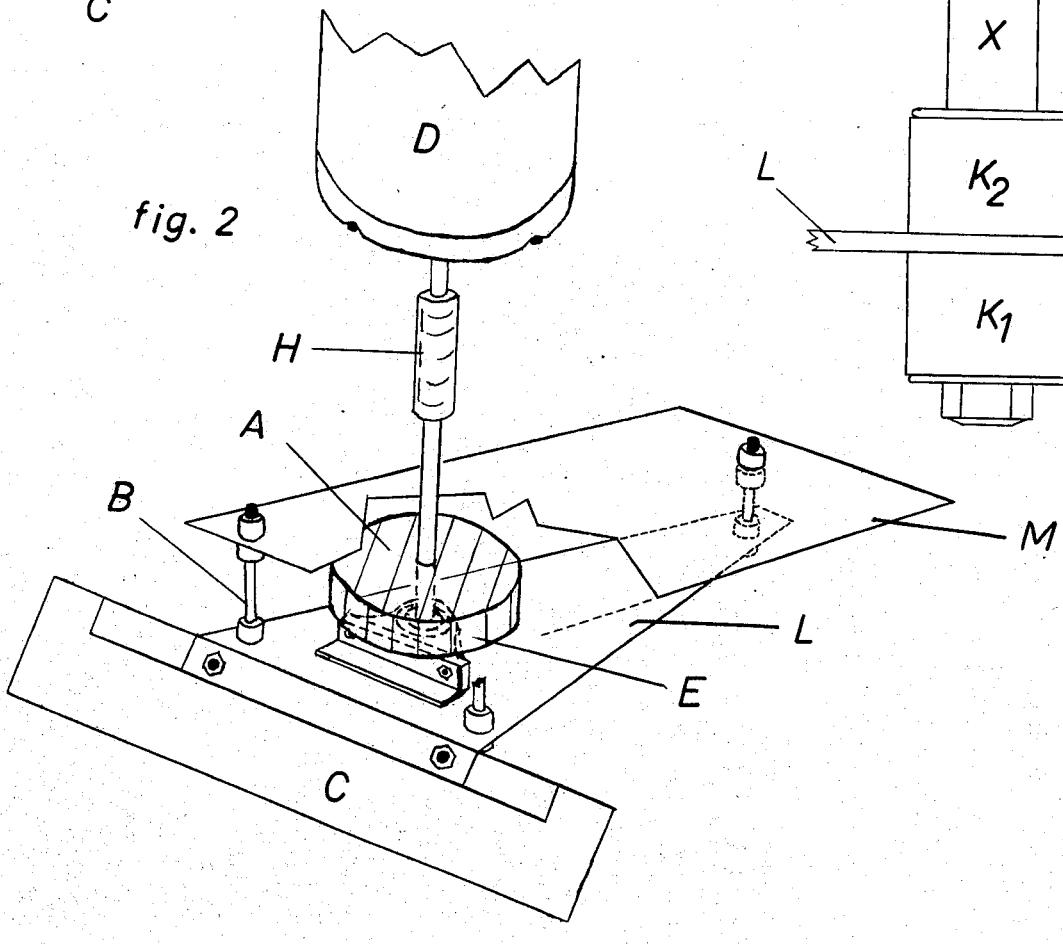

The drawing FIG. 2 shows the internal view of the machine with the floating flywheel and tool holding assembly.

Figure 3:
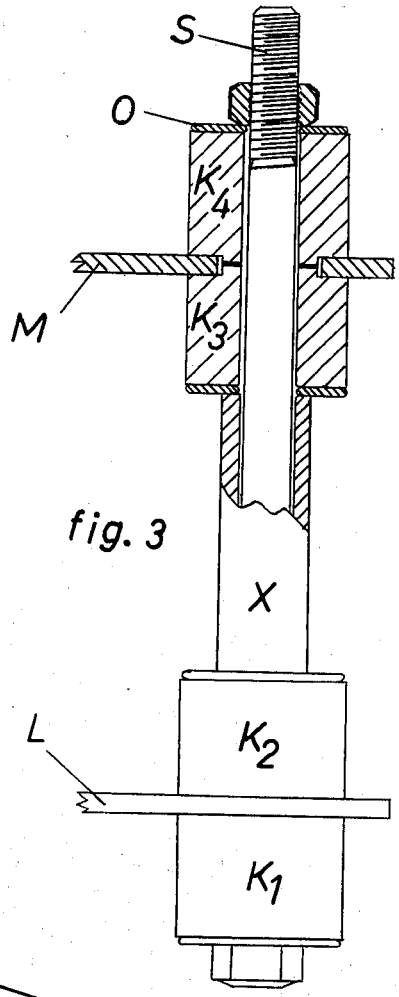

The drawing FIG. 3 shows an arrangement used to allow the tool holder-flywheel assembly to float or move with respect to the machine.

FIG. 1

C. Tool (blade) attached to a tool holding plate
W. Wheels mounted on the bottom of a frame
D. Motor (electric, could be internal combustion.) attached to the frame
F. Cord and switch wired to the motor
G. Telescoping handle attached frame

FIG. 2

C. Tool (blade) attached to the tool holding plate
E. Pillow block bearing attached to the top of the tool holding plate
A. Flywheel with a shaft offset from the center of the flywheel.
D. Motor
H. Flexible coupling arrangement between motor D and flywheel A.
M. Base plate of machine attached to the frame
L. Tool holding plate attached to the base plate by a flexible vibration dampener.

FIG. 3

S. Bolt with nut.
O. Washers.
M. Base plate of machine attached to the base plate by the flexible vibration dampener.
L. Tool holding plate of machine attached to the base plate by the flexible vibration dampener.
X. Spacer bushing.
K. 1–4 Rubber grommets.

In order to eliminate the circular motion generated by the tool holding plate L and flywheel A from being transmitted to the rest of said machine a flexible vibration dampener shown in FIG. 3 is used to attach the base plate M of said machine to the tool holding plate L of said machine. Notice K 1–4 are used, allowing flexure or movement between M. and L.

Flexible coupling H between motor D and flywheel A prevents excessive vibration from being transmitted from A to D.

The above said flexible vibration dampening attachments effectively isolate the circular motions generated by A and L from reaching M and D. Thus A and L could be said to "float."

The arrangement shown in FIG. 3 so effectively keeps the vibration of the flywheel from reaching the rest of the machine that practically no vibration reaches the operator at the handle. The stiffness of this rubber coupling arrangement can be varied by tightening or loosening bolt S.

Besides providing the inertia or "base" from which to move the tool holder L, the flywheel A also acts as a power storage device as is the character of a flywheel. Because the flywheel does store a considerable amount of power it is able to keep the blade cutting through obstructions that the motor alone would not have the power to cut through in the conventional design. Thus a machine of this type can use a much smaller motor than a machine of conventional design.

Because the shaft that passes thru the flywheel A is offset from the center of the flywheel, as the flywheel revolves the shaft moves in an eccentric motion about the center of the flywheel. The reason for this is that the flywheel centers itself as it spins gyroscopically. The eccentric motion of the shaft is transmitted to the tool by means of bearing E and plate L.

It should be understood that the matter hereinbefore shown and described should not be taken in a limiting sense. For example the flywheel arrangement shown could be used in a horizontal position and not in a vertical position as shown in the drawing. When used in the horizontal position the flywheel imparts more of a chopping action to the tool than it does when the axis of the flywheel is vertical.

What I claim is:

1. A surface preparation machine for removing material adhered to a planar surface, the machine comprising:

a wheeled frame having an upper portion and lower portion;

a motor mounted to the upper portion of said frame;

a vertical shaft attached at one end to said motor and extending downwardly therefrom;

an annular shaped flywheel attached to said shaft, said shaft offset from the center of said flywheel and extending therethrough;

a horizontal base plate attached to the lower portion of said frame, said base plate having an aperture therein for receiving said shaft therethrough;

a horizontal tool holding plate disposed below said base plate and parallel thereto, the other end of said shaft attached to said tool holding plate, said plate having a tool mounted thereon for removing the material; and coupling means for attaching said plate to said base plate and suspending said plate therefrom;

said motor rotating said flywheel and said shaft, said shaft providing an eccentric motion in providing an orbital movement of said tool holding plate in a horizontal plane.

2. The machine as described in claim 1, wherein said coupling means include a plurality of bolts extending through apertures in said base plate and said tool holding plate and secured thereto by threaded bolts, said bolts having rubber grommets therearound for absorbing the vibration imported from said tool holding plate to said base plate.

3. The machine as described in claim 1, wherein said vertical shaft is attached to said tool holding plate by a pillow block bearing, said bearing mounted on top of said tool holding plate and receiving the end of said shaft therein.

4. The machine as described in claim 1, further including a flexible coupling mounted on said shaft and connecting said shaft to said motor for reducing vibrations between said flywheel and said motor.

5. The machine as described in claim 1, wherein said flywheel mounted on said shaft is disposed between said base plate and said tool holding plate.

* * * * *